US006227534B1

(12) United States Patent
Schoedinger et al.

(10) Patent No.: US 6,227,534 B1
(45) Date of Patent: May 8, 2001

(54) METHOD AND APPARATUS FOR CONTROLLING AN AUTO COMPENSATION PICK MECHANISM TO REDUCE THE OCCURENCE OF MULTI-FEEDS

(75) Inventors: Kevin Dean Schoedinger, Nicholasville; Ronald Todd Sellers, Lexington; Scott Stephen Williams, Versailles; Phillip Byron Wright, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/438,910

(22) Filed: Nov. 12, 1999

(51) Int. Cl.[7] ..... B65H 3/06

(52) U.S. Cl. ..... 271/114; 271/110; 271/121; 271/270

(58) Field of Search ..... 271/109, 110, 271/111, 114, 116, 117, 121, 118, 270

(56) References Cited

U.S. PATENT DOCUMENTS

| | | | |
|---|---|---|---|
| 4,318,540 | | 3/1982 | Paananen et al. . |
| 4,444,385 | | 4/1984 | Berry . |
| 4,519,601 | | 5/1985 | Watanabe . |
| 4,605,215 | | 8/1986 | Hyltoft . |
| 4,798,373 | | 1/1989 | Hyltoft . |
| 4,940,224 | | 7/1990 | Couper . |
| 4,986,525 | | 1/1991 | Takagi et al. . |
| 5,129,641 | * | 7/1992 | Long ..... 271/270 |
| 5,172,900 | | 12/1992 | Uno et al. . |
| 5,342,037 | | 8/1994 | Martin . |
| 5,461,468 | | 10/1995 | Dempsey et al. . |
| 5,527,026 | | 6/1996 | Padget et al. . |
| 5,531,435 | | 7/1996 | Momose . |
| 5,575,467 | | 11/1996 | Williams . |
| 5,575,469 | | 11/1996 | Coombs et al. . |
| 5,622,364 | * | 4/1997 | Dutton et al. ..... 271/110 |
| 5,932,313 | * | 8/1999 | Barton ..... 271/117 |

* cited by examiner

*Primary Examiner*—H. Grant Skaggs
(74) *Attorney, Agent, or Firm*—Ronald K. Aust, Esq.; D. Brent Lambert

(57) ABSTRACT

Method and apparatus for controlling a sheet feeder assembly for an imaging apparatus, the sheet feeder assembly including a motor coupled to a gear train for applying a rotational force to a sheet picker roller, a media supply tray for holding a media stack having a plurality of media sheets, and a buckler for buckling a top sheet of print media to separate the top sheet from the media stack, the method including the steps of driving the sheet picker roller at a initial velocity until a backlash of the gear train is eliminated and/or the top sheet has been buckled; and thereafter, accelerating the sheet picker roller from the initial velocity to a target velocity using selectable sheet picker roller velocity profiles.

23 Claims, 3 Drawing Sheets

SHEET PICKER ROLLER VELOCITY PROFILE

SHEET PICKER ROLLER VELOCITY PROFILE

METHOD AND APPARATUS FOR CONTROLLING AN AUTO COMPENSATION PICK MECHANISM TO REDUCE THE OCCURENCE OF MULTI-FEEDS

BACKGROUND OF THE INVENTION

1. Field of the Invention

The present invention relates to an imaging apparatus, and more particularly, to an auto-compensating pick mechanism for an imaging apparatus and operating method therefor.

2. Description of the Related Art

A typical image forming apparatus, such as an electrophotographic printer, includes a media sheet supply system having a sheet feed assembly and a supply tray which holds a plurality of print media sheets, such as paper. The media sheets are held in the supply tray until a print job is requested, and ideally are transported one by one to an electrophotographic (EP) assembly within the printer where a latent image is transferred thereto.

One type of sheet feed assembly is an auto compensating sheet feeding assembly. The auto compensating sheet feeding assembly includes a pick roller (or pick rollers) and a gear train which transmits both a rotational force and a downward force to the pick roller. In such an auto compensating sheet feeding assembly, the pick arm is pivoted around its input gear causing a rotation of the pick arm and pick roller to apply increasing pressure by the pick roller to the top sheet until the top sheet is moved.

A supply tray of an image-forming apparatus can be variously configured. For example, one known configuration includes a supply tray having a comer buckler. In a comer buckler system, the pick roller engages the top sheet of the media stack, and transports it toward the comer buckler. The top sheet engages the comer buckler to separate it from the immediately subsequent sheet, and ideally, only it passes the buckler and moves into the paper path.

Another type of known supply tray includes a ramped surface, or dam, at an end thereof which is used to buckle (bend) and separate the top sheet from the immediately subsequent sheet. The pick roller picks the top sheet of the paper stack and moves the top sheet into a paper path having the dam at an end thereof. The moved sheets engage the dam and ideally only the top sheet is separated from the immediately subsequent sheet and passes the dam into the paper path of the printer.

In such media sheet supply systems, however, certain operating situations can occur wherein the auto compensating sheet picker simultaneous picks two or more sheets of media from the media stack. This is commonly referred to as a multi-feed.

Such multi-feeds often result in jamming the paper path of the imaging apparatus.

The auto compensator pick technology is designed to feed a wide range of media weights without requiring adjustments or special trays. This technology is based upon a design that applies only as much normal force to the paper stack as is necessary to overcome the resistance produced by the separating device, such as a comer buckler or a dam. Light weight paper typically requires little normal force, whereas heavyweight paper requires large normal forces. The range of printer speeds with which this technology is used is also large. However, there exists some media whose characteristics fall outside the normal ?high force for heavy, low force for light? rule. In addition, it has been found that as the print speed goes up, the surface velocity control of the sheet picker roller becomes more critical. With traditional velocity control, as the printer speed goes up, the amount of initial normal force goes up as well, primarily due to the amount of back lash in the gear drive train of the system. This results in an increase in multi-feeds.

Backlash occurs to some extent in all gear trains. The more gears in the path from source to destination, the more backlash exists. When the backlash is taken up at a slow speed, the jerk to the roller surface (the change in acceleration per unit time, da/dt) is low. Jerk at the roller surface translates into a spike in normal force to the stack assuming there is no slip from the drive roller to the paper. If the speed of the motor increases quickly, i.e., the acceleration is quick, the jerk to the paper can be large if the driving force has reached its speed before the backlash in the gear train is reached. Thus, the amount of normal force applied to the paper stack is directly proportional to the amount of jerk. Ideally, the normal force applied to the stack should only be enough to offset the force applied by the paper to the roller surface (caused by the paper being stopped by the buckler or dam). Any additional normal force tends to allow sheets to stick together and travel as a pack.

Therefore, a need exists for a method and apparatus for controlling an auto compensator pick mechanism to reduce the occurrence of multi-feeds.

SUMMARY OF THE INVENTION

The present invention provides for the reduced occurrence of multi-feeds in an imaging apparatus utilizing an auto compensator pick mechanism by delaying acceleration to a target speed of the sheet picker roller until a backlash of the gear train of the auto compensator mechanism is eliminated and/or the top sheet of a stack of print media has been buckled. As used herein, the term ?buckle? and derivative forms thereof will generically refer to the separation of a top sheet from a subsequent sheet in a stack of media.

The invention comprises, in one form thereof, method and apparatus for controlling a sheet feeder assembly for an imaging apparatus. The sheet feeder assembly includes a motor coupled to a gear train for applying a rotational force to a sheet picker roller, a media supply tray for holding a media stack having a plurality of media sheets, and a buckler for buckling a top sheet of print media to separate the top sheet from the media stack.

One method of the invention includes the steps of driving the sheet picker roller at a first velocity until the backlash of the gear train is eliminated and/or the top sheet has been buckled; and thereafter, accelerating the sheet picker roller from the first velocity to a second velocity.

Preferably, a period of the first velocity is based on at least one of a measured current of the motor, a predetermined time, and a sensor output signal, indicative of when the backlash of the gear train is eliminated and/or the top sheet has been buckled. The second velocity is a target velocity for the sheet picker roller.

In another form, a method of the invention includes the steps of providing a first drive profile for the sheet picker roller, wherein the first drive profile defines an initial velocity at which the sheet picker roller is driven until the backlash of the gear train is eliminated and/or the top sheet has been buckled, and defines an acceleration rate at which the sheet picker roller accelerates from the initial velocity directly to a target velocity; provides a second drive profile for the sheet picker roller, wherein the second drive profile defines the initial velocity at which the sheet picker roller is driven until the backlash of the gear train is eliminated and/or the top sheet has been buckled, and defining an acceleration rate at which the sheet picker roller accelerates from the initial velocity to an over-speed velocity higher than the target velocity, and defines a deceleration rate at which the picking roller decelerates to the target velocity; and selecting one of the first drive profile and the second drive profile.

Preferably, a period of the initial velocity is based on at least one of a measured current of the motor, a predetermined time, and a sensor output signal indicative of when the backlash of the gear train is eliminated and/or the top sheet has been buckled.

In preferred methods of the invention, the method further includes the steps of establishing a desired rate of throughput of media through the media sheet path; determining an actual rate of throughput of media through the media sheet path; and if the actual rate of throughput is not less than the desired rate of throughput, the selecting step selects the first drive profile for a subsequent operation of the sheet picker roller, and if the actual rate of throughput is less than the desired rate of throughput, the selecting step selects the second drive profile for a subsequent operation of the sheet picker roller. The sheet picker roller is driven at the initial velocity until the backlash of the gear train is eliminated and/or the top sheet has been buckled.

An advantage of the present invention is that the acceleration of the sheet picker roller to the target velocity is delayed until after the backlash of the gear train is eliminated and/or the top sheet to be fed has been buckled so as to reduce or eliminate the occurrence of multi-feeds.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
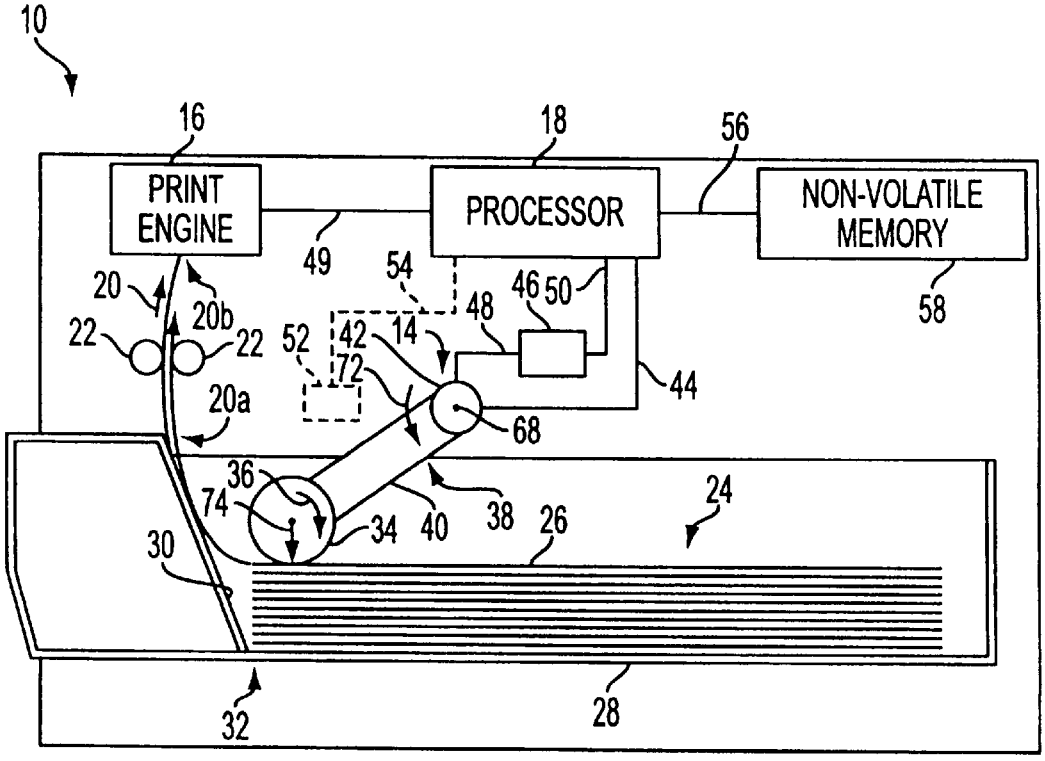
FIG. 1 is a schematic side view of an embodiment of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings, and particularly to FIG. 1, there is shown an embodiment of an image forming apparatus 10 of the present invention, which is in the form of an electrophotographic printer. Printer 10 includes a supply tray 12, a sheet picker assembly 14, a print engine 16 and a processor, or controller, 18. Printer 10 also defines a media path, or paper path, through which media sheets travel, as indicated generally by arrow 20. Media path 20 includes an input port 20*a* and an output port 20*b*. A plurality of rollers, such as rollers 22, are disposed within printer 10 along paper path for guiding and/or feeding a media sheet through paper path 20.

Supply tray 12 contains a plurality of media sheets or paper sheets 24 (also commonly referred to as a media stack) disposed within supply tray 12. Media sheets 24 can be in the form of various types of print media, as is known. Media sheets 24 rest directly on a bottom 28 of supply tray 12. A ramped surface or dam 30 is disposed at an end of supply tray 12 adjacent to paper path 20. In the embodiment shown, dam 30 is disposed adjacent to an end 32 of supply tray 12. Dam 30 is positioned at an angle relative to bottom 28, such that a top media sheet 26 which is pushed against dam 30 by sheet picker assembly 14 is deflected in an upward direction into paper path 20.

Sheet picker assembly 14 includes a movable sheet picker roller 34 which rests on top of a top media sheet 26 of media sheets 24. Sheet picker roller 34 rotates in the direction indicated by arrow 36 to move a media sheet 26 into paper path 20. More particularly, pick assembly 14 is pivotable about a pivot point 68 such that pick roller 34 is caused by gravitational force to rest against a top media sheet 26. A drive train 38 includes a housing 40, and includes a plurality of gears, pulleys, belts or the like for transferring rotational power from a power source to pick roller 34. The power source may be in the form of a motor, such as a D.C. motor 42, forming a part of sheet picker assembly 14, or may be in the form of a separate motor (not shown) which is coupled to sheet picker assembly 14 using a clutch or the like. D.C. motor 42 is connected to and controlled by processor 18 via conductor 44.

D.C. motor 42 is connected to an electrical supply 46 via a cable 48. The current supplied to D.C. motor 42 by electrical supply 46 is monitored by processor 18, which receives data representing the D.C. motor drive current via conductor 50. Processor 18 is further connected to print engine 16 via a multi-conductor connection 49 to control the operation thereof.

Processor 18 generally is of known construction and may include various required or optional hardware, such as a microprocessor, RAM memory, data buffer, etc. Processor 18 controls the operation of D.C. motor 42 and in turn controls movement of sheet picker roller 34. More particularly, processor 18 provides a signal over conductor 44 which is used to control the operation of D.C. motor 42. Optionally, processor 18 may receive an output signal from a sensor 52 (shown by phantom lines) indicating that a leading edge of a media sheet 26 has contacted darn 30. If sensor 52 is present, it is connected to processor 18 via conductor 54.

Processor 18 is also connected via a multi-line conductor 56 to a non-volatile memory 58, which preferably is in the form of a read only memory (ROM) or a programmable non-volatile memory such as an EEPROM or flash memory. Of course, memory 58 can be separate from processor 18 as shown, or can also be incorporated therewith. Memory 58 may include parameters stored therein which are associated with various drive profiles of sheet picker roller 34. Such drive profiles define the velocity and acceleration characteristics which are used to selectively control the operation of sheet picker roller 34 under certain predefined operating conditions of printer 10. Memory 58 may also include a look-up table which contains one or more of a plurality of data values to which values corresponding to data signals from D.C. motor electrical supply 46 or sensor 52 can be compared.

Figure 2:
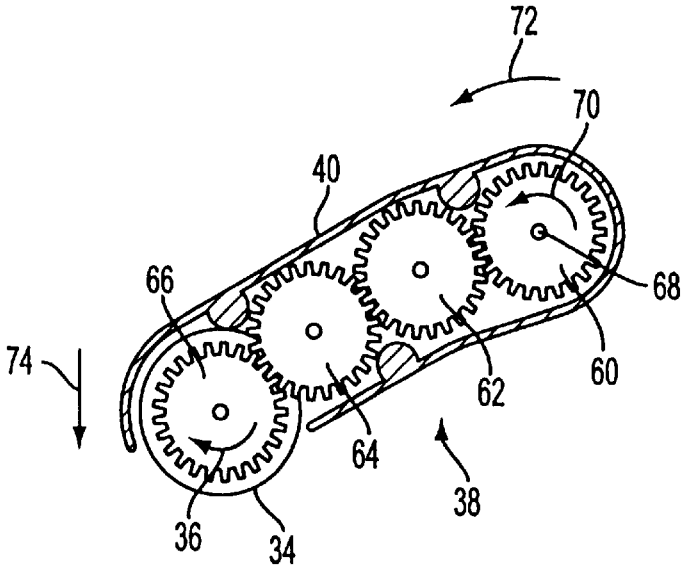
FIG. 2 is a side sectional view of the sheet picker arm gear train of FIG. 1.

FIG. 2 is an illustrative embodiment of the drive train 38 contained in pick arm housing 40. Pick arm housing 40 houses a driven gear 60, intermediate idler gears 62 and 64, and a drive gear 66. Pick arm housing 40 is pivoted at point 68, which is at the center of gear 60. A rotational force imparted to driven gear 60 is transmitted via intermediate gears 62, 64 to drive gear 66. Preferably, drive gear 66 is integral with sheet picker roller 34, and thus, rotation a drive gear 66 effects a corresponding rotation of sheet picker roller 34.

Referring now to FIGS. 1 and 2, sheet picker roller 34 rests on the top of media stack 24, and functions to move top media sheet 26 in the feed direction of media path In an operation to feed top media sheet 26, driven gear 60 is rotated by D.C. motor 42 in a counterclockwise direction, as shown illustratively by arrow 70. This immediately places a counterclockwise torque (shown illustratively by arrow 72) on pick arm housing 40 which is free to pivot at pivot point 68. The gear train 38 formed by 60, 62, 64 also translates rotary force to turn drive gear 66, and to therefore turn sheet picker roller 34 in a clockwise direction, as indicated by arrow 36.

Assuming that sheet picker roller 34 does not slip and start to rotate, the applied torque will cause an increased normal force in the direction of arrow 74 between sheet picker roller 34 and top media sheet 26. The top sheet 26 of media stack 24 is pressed with increasing force until sheet picker roller 34 begins to rotate. As sheet picker roller 34 turns, sheets of media of media stack 24, including top sheet 26 and possibly other sheets immediately below top sheet 26, begin to move toward dam 30 due the frictional adhesion between the peripheral surface of sheet picker roller 34 and top sheet 26, and frictional characteristics of adjacent sheets. Any moved sheet, including top sheet 26, is transported by the rotation of sheet picker roller 34 into contact with buckler dam 30, at which time the restriction of movement of sheet 26 again causes the torque applied by gear train 38 to increase the normal force in the direction of arrow 74 between sheet picker roller 34 and top media sheet 26. Gear train 38 will remain locked and the normal force will continue to build up until sheet 26 buckles, and the buckled sheet is transported into media path 20. If the normal force becomes too great multi-feeding can occur. To avoid multi-feeding, processor 18 utilizes suitable, and selectable, sheet picker roller velocity profiles to control the operation of sheet picker roller 34 to adjust this normal force to reduce the occurrence of multi-feeds. Such velocity profiles are shown in FIGS. 3 and 4.

Figure 3:
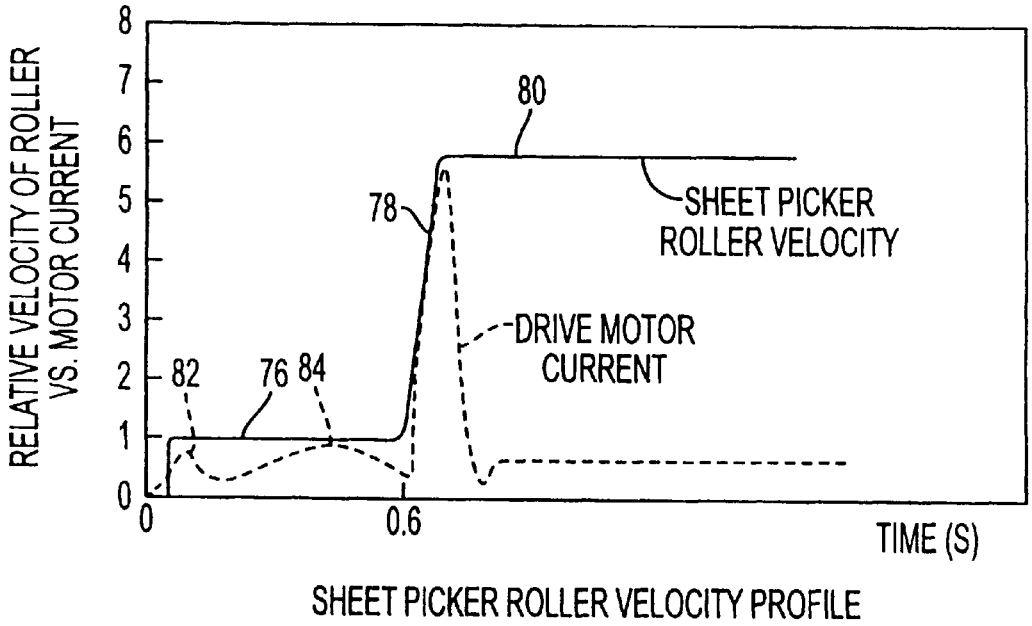
FIG. 3 is a graphical representation of a first sheet picker motor drive profile of the present invention.
Figure 4:
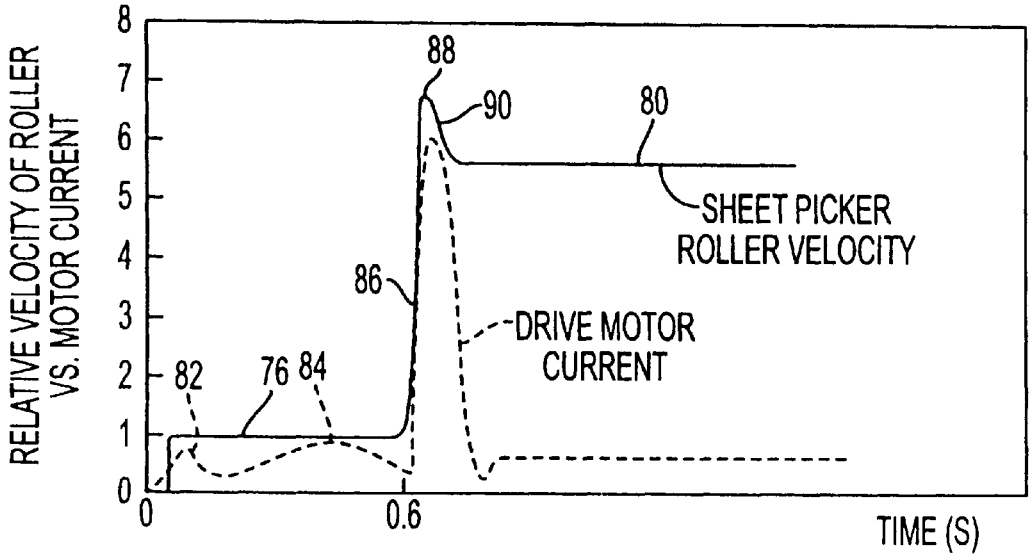
FIG. 4 is a graphical representation of a second sheet picker motor drive profile of the present invention.

FIGS. 3 and 4 each illustrate sheet picker roller velocity profiles, with the sheet picker roller velocity shown graphically as a solid line and the D.C. motor current shown graphically by dashed line. The vertical axis of the graph illustrates the relative velocity of the sheet picker roller verses D.C. motor current, and the horizontal axis depicts time.

Referring now to FIG. 3, at times the sheet picker roller is accelerated to a first, or initial velocity 76 which is maintained for a period of time, and then accelerated as depicted by acceleration ramp 78 directly to a second, or target, velocity 80. The initial velocity 76 is maintained until the backlash of the gear train 38 of the sheet picker assembly 14 (see FIGS. 1 and 2) is eliminated and top sheet 26 has engaged dam 30 for buckling to separate sheet 26 from a remainder of the sheets and media stack 24. As shown in FIG. 3, the elimination of the backlash in the gear train 38 is illustrated by a first bump 82 in the D.C. motor current graph and the buckling of sheet 26 is illustrated as the bump 84 in the D.C. motor current graph. Preferably, the velocity of sheet picker roller 34 is maintained at initial velocity 76 until both the backlash in the drive train is eliminated and the buckling of the sheet has occurred.

The most preferred way in which to determine when both the backlash elimination event and the sheet buckling event have occurred is to monitor the current supply to the D.C. motor to detect the occurrence and passing of current bumps 82 and 84 of the current graph of FIG. 3. Alternatively, however, on a given machine the occurrence of these events may be assumed after a predetermined amount of time or distance, determined empirically, and the predetermined time or distance is stored in non-volatile memory 58. Distance can be determined, for example, by monitoring feedback signals from the motor system which relate to the rotational position of the motor. For example as shown in FIGS. 3 and 4, both events occur approximately 0.6 seconds following the initiation of current to the D.C. motor to begin to rotate sheet picker roller 34. Also, alternatively the initial velocity 76 could be maintained only for such time as to eliminate the backlash in the gear train 38.

FIG. 4 is substantially similar to FIG. 3, except for the inclusion of an over-speed velocity 88 which is reached before achieving the steady state target velocity 80. By accelerating to over-speed velocity 88, sheet 26 is moved into media path 20 more quickly than would have occurred using the velocity profile of FIG. 3. The sheet pick roller is accelerated, as depicted by acceleration ramp 86, to over-speed velocity 88, and then decelerated, as depicted by deceleration ramp 90, to target velocity 80. The acceleration and deceleration rates are determined and selected based upon the operational characteristics of imaging apparatus 10 and its associated components, and may be selected to provide the maximum acceleration and/or deceleration available from imaging apparatus 10.

Preferably, the sheet picker roller velocity profile of FIG. 3 is used when the actual rate of sheet throughput is not less than a predetermined desired rate of throughput and the sheet picker roller velocity profile illustrated in FIG. 4 is used when the actual rate of sheet throughput through imaging apparatus 10 is less than the desired rate of throughput.

Figure 5:
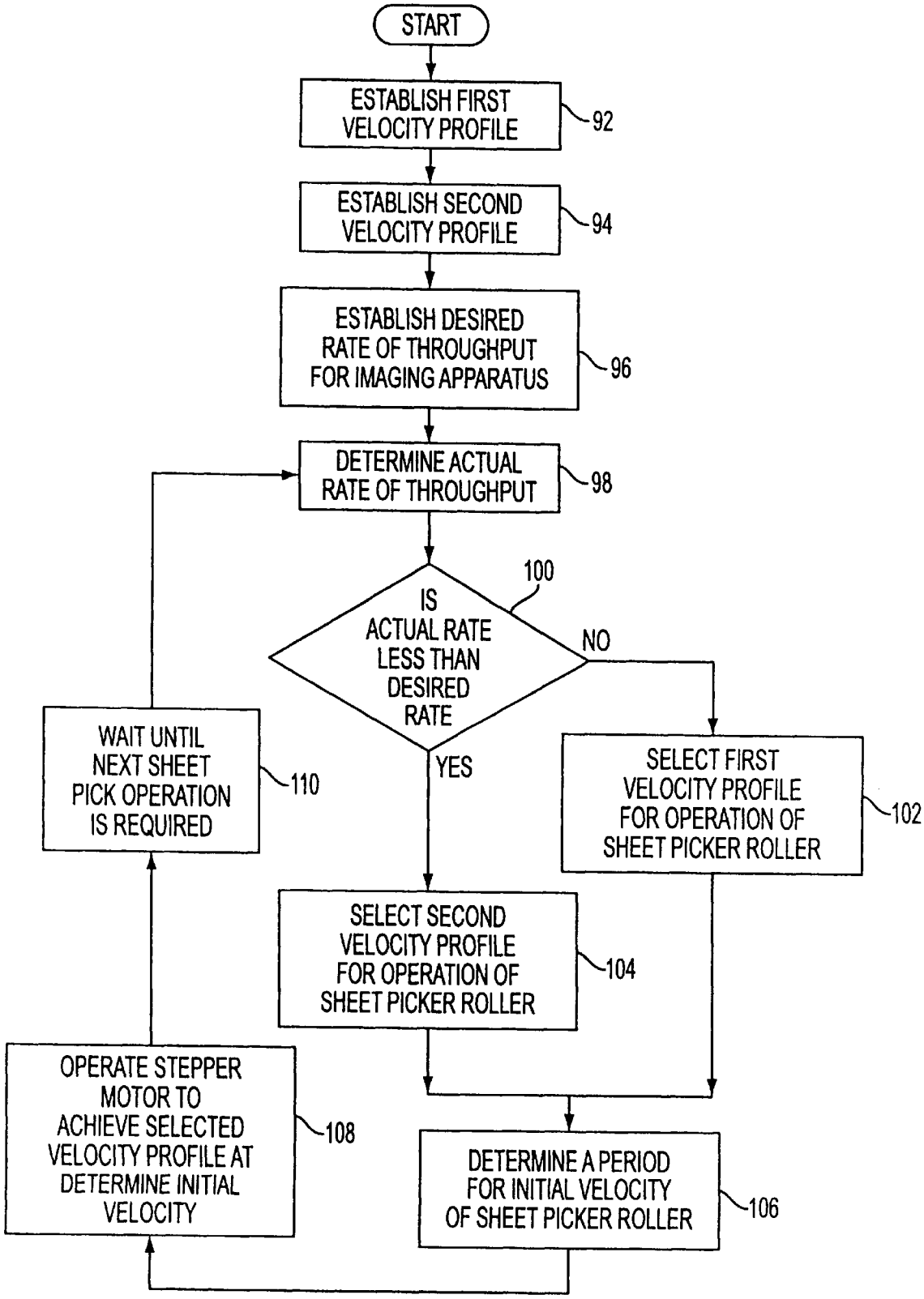
FIG. 5 is flow chart illustrating the control logic of the present invention.

FIG. 5 is a flow chart which illustrates the control logic of the present invention. Initially, and prior to using image forming apparatus 10, data corresponding to the first drive profile of FIG. 3, data corresponding to the second drive profile of FIG. 4 and a desired rate of throughput for imaging apparatus 10 is stored in non-volatile memory 58 of imaging apparatus 10. These steps are illustrated in the flow chart of FIG. 5 as steps 92, 94, and 96, respectively. At step 98, processor 18 determines an actual rate of throughput of sheets through imaging apparatus 10. Since processor 18 controls both the operation of the sheet picker assembly 14 and the operation of print engine 16, the processor has information available which permits the determination of an actual rate of throughput of imaging apparatus 10 as illustrated by flow chart step 98.

At step 100, processor 18 determines whether the actual rate of throughput for imaging apparatus 10 is less than the predefined desired rate of throughput. If the actual rate of throughput is not less than the desired rate of throughput, then processor 10 selects the first profile illustrated in FIG. 3 and accesses the corresponding data in nonvolatile memory 58. If, however, the actual rate of throughput is less than the desired rate of throughput, then processor 18 selects the second profile illustrated in FIG. 4, and accesses corresponding data stored in non-volatile memory 58. The program flow then proceeds from the selected one of the selected steps 102, 104 to step 106, at which time processor 18 determines a period for the first, or initial, velocity 76.

Preferably, processor 18 monitors the current that electrical supply 46 supplies via cable 48 to D.C. motor 42. Electrical supply 46 provides data corresponding to the current flow to D.C. motor 42 via conductor 50. Referring to FIGS. 3 and 4, processor 18 monitors the current to identify a conclusion of the current spike 82 indicative of the take up of the backlash of the gear train 38 and/or the conclusion of buckling indicated by the end of the current bump 84.

Alternatively, as shown with reference to FIGS. 3 and 4, processor 18 accesses non-volatile memory 58 to retrieve predetermined time or distance data corresponding to a time period or rotational distance traveled by the motor from an initial starting of the sheet picker roller 34 at time zero to a time or rotational distance which generally encompasses the backlash event and/or the buckling event, and could be for example 0.6 seconds, or an equivalent rotational distance traveled by D.C. motor 42 as indicated in FIGS. 3 and 4.

A further alternative would be to monitor the optional sensor 52 (see FIG. 1) to determine when the buckling has been completed and receive a corresponding signal via conductor 54.

Once processor 18 has determined a period for first, or initial velocity 76, the flow in FIG. 5 continues to step 108 at which time D.C. motor 42 is operated in accordance with the selected profile using the initial time period for velocity 76 determined at step 106. Program flow then continues to step 110, at which time the processor checks to determine whether the desired rate of throughput has changed. If the result of the decision is NO, then the flowchart returns to step 108 to operate the drive motor to achieve the selected velocity profile at the determined initial velocity. If the result of the decision is YES, then the flowchart proceeds back to step 98 to again determine the actual rate of throughput of imaging apparatus 10, and then repeats steps 100 through 110.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for controlling a sheet feeder assembly for an imaging apparatus, said sheet feeder assembly including a motor coupled to a gear train for applying a rotational force to a sheet picker roller, a media supply tray for holding a media stack having a plurality of media sheets, and a sheet separator for buckling a top sheet of print media to separate said top sheet from said media stack, said method comprising the steps of:

driving said sheet picker roller at a first velocity until at least one of a backlash of said gear train is eliminated and said top sheet has been buckled; and thereafter, accelerating said sheet picker roller from said first velocity to a second velocity.

2. The method of claim 1, wherein a period of said first velocity is based on at least one of a measured current of said motor, a predetermined time, and a sensor output signal, indicative of when at least one of a backlash of said gear train is eliminated and said top sheet has been buckled.

3. The method of claim 1, wherein said second velocity is a target velocity for said sheet picker roller.

4. The method of claim 3, wherein said accelerating step further comprises the step of accelerating to an over-speed velocity higher than said target velocity and then decelerating said sheet picker roller to said target velocity.

5. The method of claim 1, wherein said driving step drives said sheet picker roller at said first velocity until both of said backlash of said gear train is eliminated and said top sheet has been buckled.

6. A method for controlling a sheet feeder assembly for an imaging apparatus, said sheet feeder assembly including a motor coupled to a gear train for applying a rotational force to a sheet picker roller, a media supply tray for holding a media stack having a plurality of media sheets, and a sheet separator for buckling a top sheet of print media to separate said top sheet from said media stack, said method comprising the steps of:

providing a first drive profile for said sheet picker roller, wherein said first drive profile defines an initial velocity at which said sheet picker roller is driven until at least one of a backlash of said gear train is eliminated and said top sheet has been buckled, and defines an acceleration rate at which said sheet picker roller accelerates from said initial velocity directly to a target velocity;

providing a second drive profile for said sheet picker roller, wherein said second drive profile defines said initial velocity at which said sheet picker roller is driven until at least one of a backlash of said gear train is eliminated and said top sheet has been buckled, and defining an acceleration rate at which said sheet picker roller accelerates from said initial velocity to an over-speed velocity higher than said target velocity, and defines a deceleration rate at which said picking roller decelerates to said target velocity; and selecting one of said first drive profile and said second drive profile.

7. The method of claim 6, wherein a period of said initial velocity is based on at least one of a measured current of said motor, a predetermined time, and a sensor output signal, indicative of when at least one of a backlash of said gear train is eliminated and said top sheet has been buckled.

8. The method of claim 6, wherein said imaging apparatus includes a print engine and a media sheet path leading to said print engine, said method further comprising the steps of:

establishing a desired rate of throughput of media through said media sheet path;

determining an actual rate of throughput of media through said media sheet path; and if said actual rate of throughput is not less than said desired rate of throughput, said selecting step selecting said first drive profile for a subsequent operation of said sheet picker roller, and if said actual rate of throughput is less than said desired rate of throughput, said selecting step selecting said second drive profile for said subsequent operation of said sheet picker roller.

9. The method of claim 6, wherein said sheet picker roller is driven at said initial velocity until both of said backlash of said gear train is eliminated and said top sheet has been buckled.

10. A method for controlling an imaging apparatus, comprising the steps of:

providing a print engine;

providing a print media path leading to said print engine;

providing a media supply tray for holding a media stack having a plurality of media sheets, said supply tray including a sheet separator for buckling a top sheet of print media to separate said top sheet from said media stack;

providing a media sheet feeder assembly for supplying said media sheet to said print media path, said media sheet feeder assembly including a motor coupled to a gear train for applying a rotational force to a sheet picker roller;

providing a first drive profile for said sheet picker roller, wherein said sheet picker roller is driven at an initial velocity until at least one of a backlash of said gear train is eliminated and said top sheet has been buckled, and thereafter, said sheet picker roller being accelerated from said initial velocity directly to a target velocity;

providing a second drive profile for said sheet picker roller, wherein said sheet picker roller is driven at said initial velocity until at least one of a backlash of said gear train is eliminated and said top sheet has been buckled, and thereafter, said sheet picker roller being accelerated from said initial velocity to an over-speed velocity higher than said target velocity, and then decelerating said picking roller to said target velocity;

establishing a desired rate of throughput of media through said media sheet path;

determining an actual rate of throughput of media through said media sheet path; and if said actual rate of throughput is not less than said desired rate of throughput, said method further comprising the step of selecting said first drive profile for a subsequent operation of said sheet picker roller, and if said actual rate of throughput is less than said desired rate of throughput, said method further comprising the step of selecting said second drive profile for said subsequent operation of said sheet picker roller.

11. The method of claim 10, wherein said sheet picker roller is driven at said initial velocity until both of said backlash of said gear train is eliminated and said top sheet has been buckled.

12. The method of claim 10, wherein a period of said initial velocity is based on at least one of a measured current of said motor, a predetermined time, and a sensor output signal, indicative of when at least one of said backlash of said gear train is eliminated and said top sheet has been buckled.

13. A sheet feeder assembly for an imaging apparatus, comprising:

a media supply tray for holding a media stack having a plurality of media sheets, said media supply tray including a sheet separator for buckling a top sheet of print media to separate said top sheet from said media stack;

a motor;

a pick arm assembly having a gear train and a sheet picker roller, said gear train having a drive gear, at least one intermediate gear and a driven gear, said driven gear being rotatably coupled to said sheet picker roller and said drive gear being rotatably coupled to said motor for applying a rotational force to a sheet picker roller via said gear train; and a controller electrically coupled to said motor, said controller including control logic for controlling said motor to drive said sheet picker roller at a first velocity until at least one of a backlash of said gear train is eliminated and said top sheet has been buckled, and thereafter, controlling said motor to accelerate said sheet picker roller from said first velocity to a second velocity.

14. The method of claim 13, wherein a period of said first velocity is based on at least one of a measured current of said motor, a predetermined time, and a sensor output signal, indicative of when at least one of a backlash of said gear train is eliminated and said top sheet has been buckled.

15. The apparatus of claim 13, wherein said second velocity is a target velocity for said sheet picker roller.

16. The apparatus of claim 15, wherein said controller controls said motor to drive said sheet picker roller at an over-speed velocity higher than a target velocity and then decelerates said picking roller to said target velocity.

17. The apparatus of claim 13, wherein said controller controls said motor to drive said sheet picker roller at said first velocity until both of said backlash of said gear train is eliminated and said top sheet has been buckled.

18. The apparatus of claim 13, wherein said first velocity corresponds to an initial velocity and said second velocity corresponds to a target velocity, and wherein said control logic is stored in a semiconductor memory and includes program instructions which perform the steps of:

identifying a first drive profile for said sheet picker roller which is stored in said memory, said first drive profile defining a delayed acceleration from an initial velocity directly to a target velocity;

identifying a second drive profile for said sheet picker roller which is stored in said memory, said second drive profile defining a delayed acceleration from said initial velocity to an over-speed velocity higher than said target velocity, and defining a deceleration from said over-speed velocity to said target velocity; and selecting one of said first drive profile and said second drive profile.

19. The method of claim 18, wherein said sheet picker roller is driven at said first velocity until both of said backlash of said gear train is eliminated and said top sheet has been buckled.

20. The apparatus of claim 13, wherein said control logic is stored in a semiconductor memory and includes program instructions which perform the steps of:

identifying a desired rate of throughput of media through a media sheet path;

determining an actual rate of throughput of media through said media sheet path; and if said actual rate of throughput is not less than said desired rate of throughput, said selecting step selecting said first drive profile for a subsequent operation of said sheet picker roller, and if said actual rate of throughput is less than said desired rate of throughput, said selecting step selecting said second drive profile for said subsequent operation of said sheet picker roller.

21. An imaging apparatus, comprising:

a print engine;

a print media path having an input port and an output port, said output port being in communication with said print engine;

a media supply tray in communication with said input port of said print media path, said media supply tray holding a media stack having a plurality of media sheets, said supply tray including a sheet separator for buckling a top sheet of print media to separate said top sheet from said media stack;

a media sheet feeder assembly in communication with said media supply tray and said print media path, said media sheet feeder supplying said media sheet to said print media path, said media sheet feeder assembly including a motor, a gear train, and a sheet picker roller, said gear train being coupled between said motor and said sheet feeder roller to transmit a rotational force from said motor to said sheet picker roller;

means for providing a first drive profile for said sheet picker roller, wherein said sheet picker roller is driven at an initial velocity until at least one of a backlash of said gear train is eliminated and said top sheet has been buckled, and thereafter, said sheet picker roller being accelerated from said initial velocity directly to a target velocity;

means for providing a second drive profile for said sheet picker roller, wherein said sheet picker roller is driven at said initial velocity until at least one of a backlash of said gear train is eliminated and said top sheet has been buckled, and thereafter, said sheet picker roller being accelerated from said initial velocity to an over-speed velocity higher than said target velocity, and then decelerating said picking roller to said target velocity;

means for defining a desired rate of throughput of media through said media sheet path;

means for determining an actual rate of throughput of media through said media sheet path; and decision means for determining if said actual rate of throughput is less than said desired rate of throughput, wherein if said actual rate of throughput is not less than said desired rate of throughput then said determining means further selecting said first drive profile for a subsequent operation of said sheet picker roller, and if said actual rate of throughput is less than said desired rate of throughput then said determining means further selecting said second drive profile for said subsequent operation of said sheet picker roller.

22. The apparatus of claim 21, wherein a period of said initial velocity is based on at least one of a measured current of said motor, predetermined time, and a sensor output signal, indicative of when at least one of a backlash of said gear train is eliminated and said top sheet has been buckled.

23. The apparatus of claim 21, wherein said sheet picker roller is driven at said initial velocity until both of said backlash of said gear train is eliminated and said top sheet has been buckled.

* * * * *